US005621384A

United States Patent [19]

Crimmins et al.

[11] Patent Number: 5,621,384

[45] Date of Patent: Apr. 15, 1997

[54] INFRARED COMMUNICATING DEVICE

[75] Inventors: James W. Crimmins, Ridgefield; James L. Saulnier, Brookfield, both of Conn.

[73] Assignee: K and M Electronics, Inc., West Springfield, Mass.

[21] Appl. No.: 540,417

[22] Filed: Oct. 6, 1995

Related U.S. Application Data

[63] Continuation of Ser. No. 97,213, Jul. 26, 1993, abandoned.

[51] Int. Cl.[6] ..... G08B 23/00

[52] U.S. Cl. ..... 340/539; 340/825.54; 340/573; 340/825.49; 340/825.44

[58] Field of Search ..... 340/573, 825.49, 340/825.31, 825.32, 539, 572, 825.44, 825.54

[56] References Cited

U.S. PATENT DOCUMENTS 4,311,065 1/1982 Schmitz ..... 308/47

4,598,275 7/1986 Ross ..... 340/573

5,062,151 10/1991 Shipley ..... 340/825.49

*Primary Examiner*—Jeffery Hofsass

*Assistant Examiner*—Albert Wong

*Attorney, Agent, or Firm*—St. Onge Steward Johnston & Reens

[57] ABSTRACT

An infrared communicating badge is provided for transmitting an infrared coded signal, such as a patient identification number. The badge includes a sealed housing having an infrared transparent segment. The badge housing contains a power source, a microprocessor, an infrared transmitter, and an infrared receiver. The badge receiver is desensitized such that it does not respond to ambient light from the surroundings and, preferably, only detects signals from a programmer. This programmer transmits a coded infrared signal, which represents the patient identification number, to the badge. After the coded infrared signal is transmitted and stored in the badge, the infrared signal is transmitted periodically to another infrared receiver, located in a remote location. The remote receiver relays the information to a base unit at which the location of a person may be monitored.

24 Claims, 7 Drawing Sheets

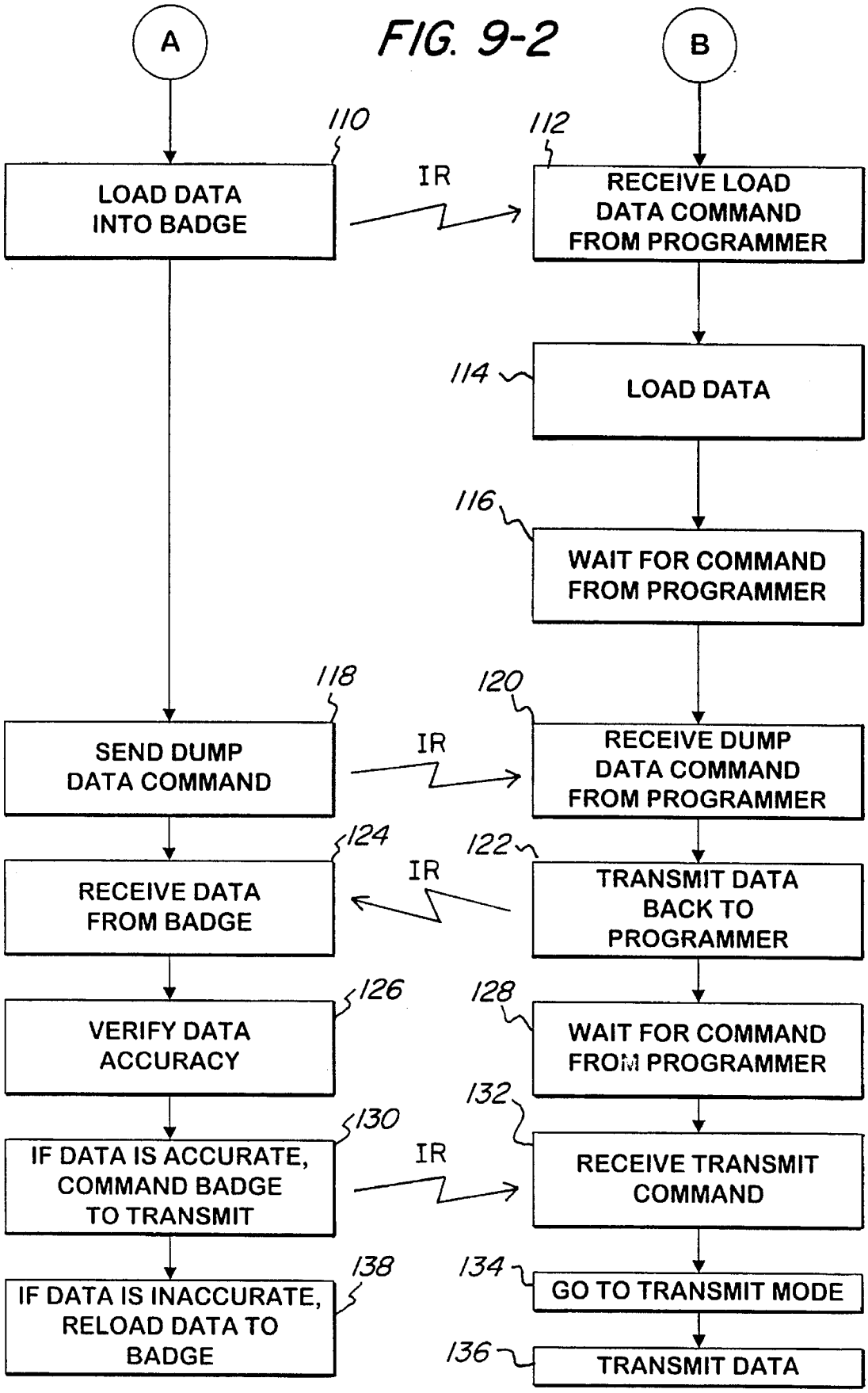
FIG. 9-2
A
B
110
LOAD DATA INTO BADGE
IR
112
RECEIVE LOAD DATA COMMAND FROM PROGRAMMER
114
LOAD DATA
116
WAIT FOR COMMAND FROM PROGRAMMER
118
SEND DUMP DATA COMMAND
IR
120
RECEIVE DUMP DATA COMMAND FROM PROGRAMMER
124
RECEIVE DATA FROM BADGE
IR
122
TRANSMIT DATA BACK TO PROGRAMMER
126
VERIFY DATA ACCURACY
128
WAIT FOR COMMAND FROM PROGRAMMER
130
IF DATA IS ACCURATE, COMMAND BADGE TO TRANSMIT
IR
132
RECEIVE TRANSMIT COMMAND
138
IF DATA IS INACCURATE, RELOAD DATA TO BADGE
134
GO TO TRANSMIT MODE
136
TRANSMIT DATA

INFRARED COMMUNICATING DEVICE

This application is a continuation of a application entitled "Infrared Communicating Device" filed on Jul. 26, 1993, and accorded Ser. No. 08/097,213 now abandoned.

FIELD OF THE INVENTION

This invention generally relates to an infrared (IR) communicating device for an enclosed area, and more particularly, to a badge which transmits IR information to a remote IR receiver used in common with the badge in a single building or structure, such as hospitals, institutions and the like.

BACKGROUND OF THE INVENTION

Some businesses have a need to monitor the locations of people or equipment. For example, hospitals might desire to monitor the location of doctors on call in the emergency room. Or, hospitals may desire to monitor the location of a patient with temporary or permanent memory loss, such as a patient with Alzheimer's disease, to aid in ensuring that the patient does not wander away from the hospital.

Infrared personnel locator systems are known in the art. U.S. Pat. No. 4,275,385 discloses such a system using a battery-powered transmitter unit which emits a periodic unique infrared identification code. U.S. Pat. No. 4,649,385 discloses a system for determining the location of a member of a class of transmitter-receivers.

One disadvantage of these systems is that the remote transmitter units are not designed to be worn by a person or otherwise used in environments such as hospitals where the units are susceptible to fluid exposure. Another drawback is that the units are typically user programmed with identification codes and other parameters by way of a physical connection or cabling to a programming device. Programming the identification code after connecting the cabling can be time consuming and cumbersome. Furthermore, to connect these cables, there must be a passageway between the cable and the receiver. Unfortunately, water and other fluids may enter this passageway and damage the internal electronics.

SUMMARY OF THE INVENTION

It is, therefore, an object of the invention to provide an infrared communication device which may be programmed with an identification code without cabling or physical connection to the device, and which is not susceptible to damage from exposure to patient fluids, such as perspiration, or other fluids, such as water.

Accordingly, it is an object of the invention to provide a moisture resistant infrared communication device.

Another object is to provide an infrared communication device having a housing which can optionally seal in the electrical components.

A further object is to provide an infrared communication device of the above character adapted to be worn by a hospital patient.

A still further object is to provide an infrared communication device of the above character which may be disposable.

Yet another object is to provide an infrared communication device of the above character which is programmable with a personal identification number and other operational parameters by an IR transceiver.

These and other objects are achieved by provision of an infrared communication device in which the electronic components are mounted in a moisture resistant housing.

The infrared communication device comprises a badge for wearing by a person or for attachment to an object.

In accordance with one form of a badge in accordance with the invention, the badge is formed with a preferably sealed housing that is approximately the size of a wrist watch and is designed to be worn as such by a patient. The badge housing is preferably moisture resistant and most preferably moisture proof for use in environments in which it is likely to be exposed to fluids which might otherwise damage the badge electronics. Preferably, the badge is also sterilizable for use and reuse in a hospital setting. Because the badge is intended to keep track of a person, it is programmable with a code or identification number uniquely associated with the person so that the badge can transmit an infrared signal representative of the identification number. Other parameters, such as badge transmission repetition rate, may also be programmed.

Preferably, the badge is programmable by an IR transceiver. Although sealed, as preferred, the badge is capable of receiving an infrared signal including an identification code for subsequent infrared transmission. A microprocessor, or other suitable logic device, which is preferably sealed inside the housing, then produces an electrical coded signal, representative of a patient's personal identification number. The electrical coded signal is applied to an infrared transmitter, which is also preferably sealed inside the housing and which generates an infrared coded signal, representative of the electrical coded signal, for detection by a local infrared receiver mounted for example in the ceiling of a hospital room.

Programming of the appropriate identification code is accomplished with an infrared receiver inside the badge housing and a programmer device. The badge receiver detects an infrared identification code from the programmer, and generates a signal used by the microprocessor to generate the electrical coded signal. The badge receiver is preferably desensitized so as only to respond to intense infrared light from the programmer. This desensitizing can be accomplished by any suitable means, such as by the back biasing of a photo detector, or back biasing an infrared diode and selecting an appropriate bias resistor value, or with the placement of infrared attenuating material in front of the infrared photo detector used for the receiver. The desensitized receiver should not respond to ambient infrared energy passing through the housing, but only to infrared identification codes from the programmer which are provided at intensity levels substantially above the intensity of ambient infrared light.

Programming is done by placing the badge in the programmer device which includes an infrared transmitter for emitting an infrared identification code of sufficient intensity to overcome the back biasing of the badge receiver. The programmer does not require a direct physical connector to the microcircuit inside the badge. The badge commences IR transmission of the identification code after the code has been loaded by infrared transmission into the badge and commanded to transmit by the programmer. This code is then transmitted by the badge to remote receivers which are scattered throughout the building.

These and other objects and advantages of the invention can be understood from the following detailed description with reference to the drawings.

DETAILED DESCRIPTION OF THE DRAWINGS

Figure 3:
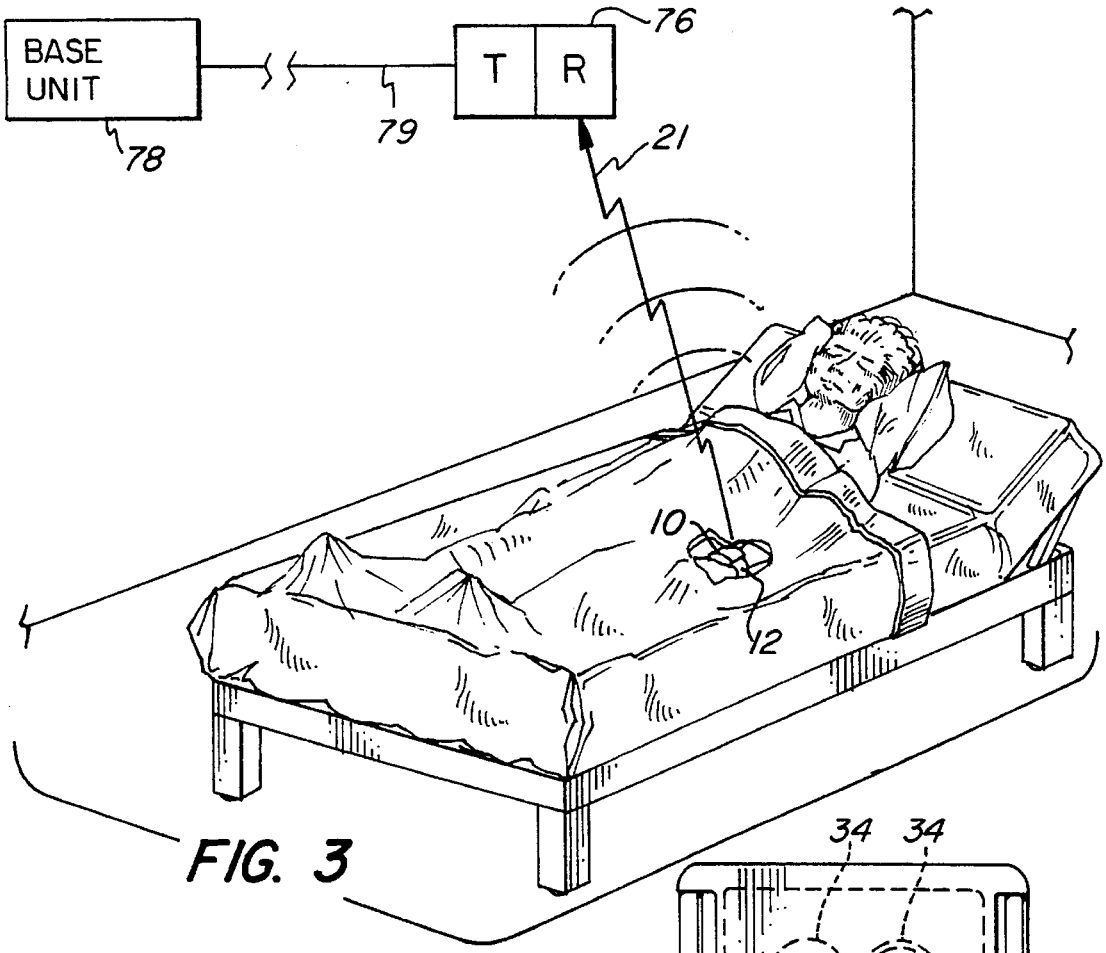
FIG. 3 is a perspective view of an end user, such as a hospital patient, wearing the sealed badge from which an infrared signal can be transmitted to a remote location.
Figure 2:
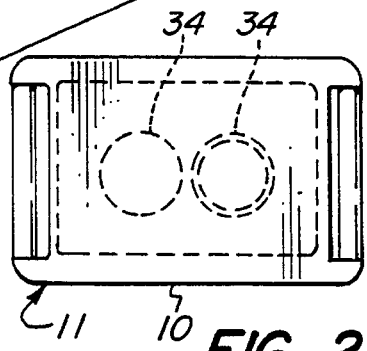
FIG. 2 is a bottom plan view of the badge in FIG. 1, with the band removed for clarity.
Figure 1:
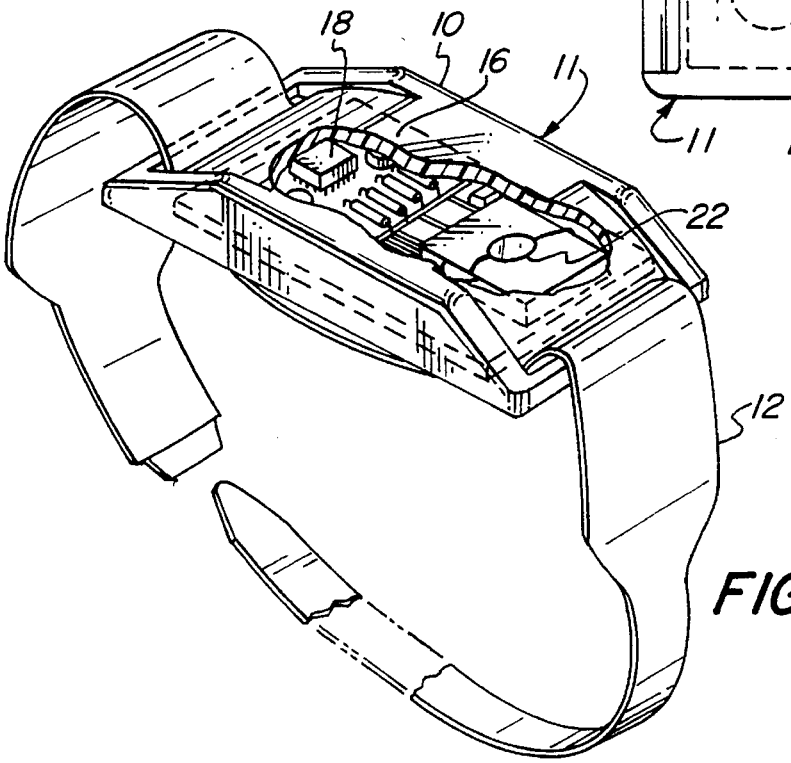
FIG. 1 is a perspective view, with portions broken away, of a sealed infrared communicating device, commonly known as a badge, with an accompanying band, constructed in accordance with the present invention.

With reference to FIGS. 1–3 an infrared communicating device 11 in accordance with the invention is shown. Device or badge 11 comprises a, preferably, permanently sealed housing 10 which is approximately the size of a wrist watch. In this regard, badge 11 preferably is used with a band 12 for securing housing 10 to a user's wrist or ankle. It is understood that housing 10 may also be pinned or clipped to a person's clothing or otherwise attached to equipment. Housing 10 is made of any suitable moisture resistant material such as LEXAN plastic, which is manufactured and marketed by the Plastics Marketing Division, a division of General Electric, located in Pittsfield, Mass.

An infrared transmitter 18 and an infrared receiver 20 are sealed inside housing 10. Housing 10 is preferably moisture resistant and most preferably moisture proof in order to prevent damage to the badge electronics from perspiration or other fluids present in a hospital or like environment. Housing 10 is also substantially IR transparent in a region 16 overlying transmitter 18. By "infrared transparent" is meant that IR signals are capable of being passed through sealed housing 10 with little attenuation and reflection.

Preferably, infrared transmitter 18 is essentially as shown and described in a U.S. Pat. No. 5,319,191 to James W. Crimmins, entitled "ASK Optical Transmitter", and hereby incorporated by reference. It is understood that other infrared transmitters may also be used.

Because housing 10 is sealed, badge 11 is programmed with an identification code, not through a physical connection or cabling as in the prior art, but through a circuit 19 (shown in FIG. 6), which, in particular, has an IR receiver 20. In this regard, receiver 20 is comprised of, most preferably, an infrared LED diode 22 which is further desensitized to ambient infrared energy passing through the infrared transparent region or segment 16 of housing 10. The diode 22, which can be a back biased infrared diode coupled in an infrared detecting mode, although in effect desensitized, must still be capable of discriminately detecting and responding to infrared coded light at an intensity level that is substantially above the intensity of ambient infrared light in order to be programmed with an identification code.

Figure 4:
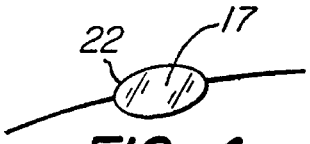
FIG. 4 is a top plan view of an infrared photo diode with an adjacent piece of infrared attenuating material.

Desensitizing can be accomplished by any number of suitable methods such as placing a piece of tape, thin film, or other infrared attenuating material, as shown in FIG. 4 at 17, directly on the surface of the infrared LED diode 22 so as to reduce the ambient infrared light which penetrates housing 10.

Similarly, housing 10 could be designed to substantially attenuate infrared signals in a region that overlies the IR detecting diode 22. This infrared attenuating material also serves to prolong the lifetime of the batteries 34 by reducing the drain on the batteries caused by ambient infrared light.

By "infrared attenuating" is, therefore, meant that ambient infrared light is attenuated, that infrared signals from other badges is attenuated, but that infrared light of an intensity greater than the intensity of ambient infrared light from the programmer 38 will pass through the region in order that the badge electronics mounted in the sealed housing 10 can be programmed with an identification code or such other information.

Figure 5:
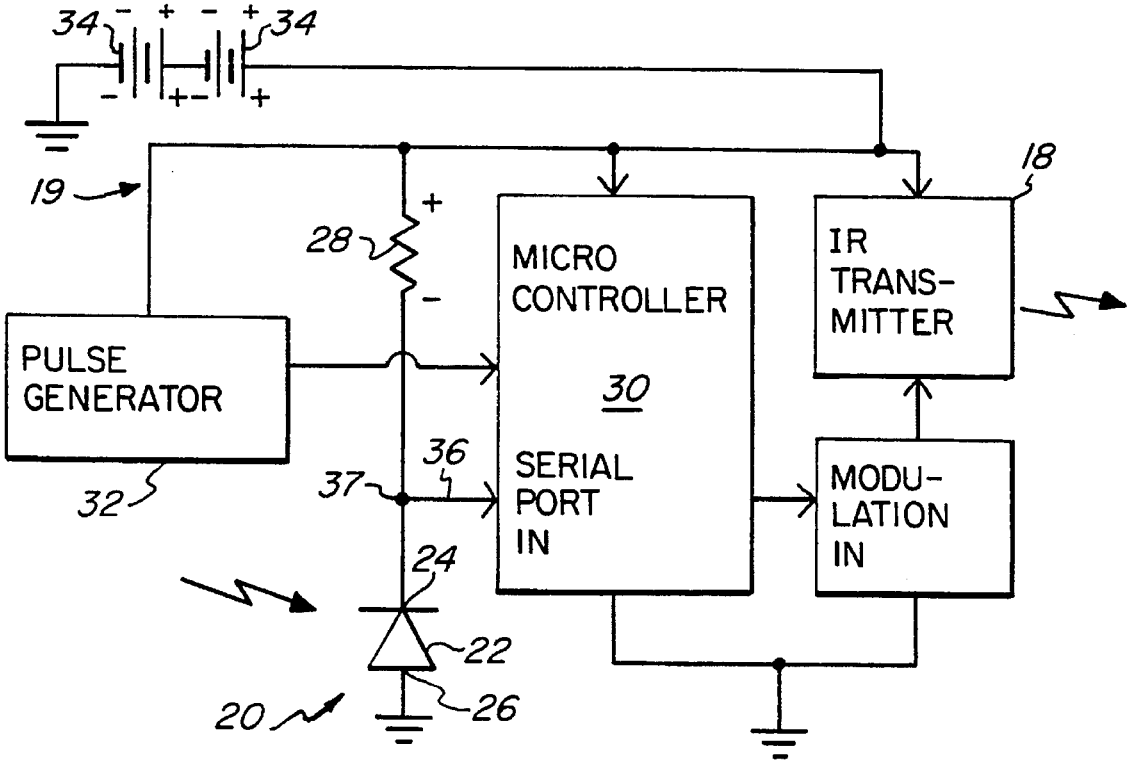
FIG. 5 is a block diagram of the circuitry housed inside the badge of FIG. 1.
Figure 6:
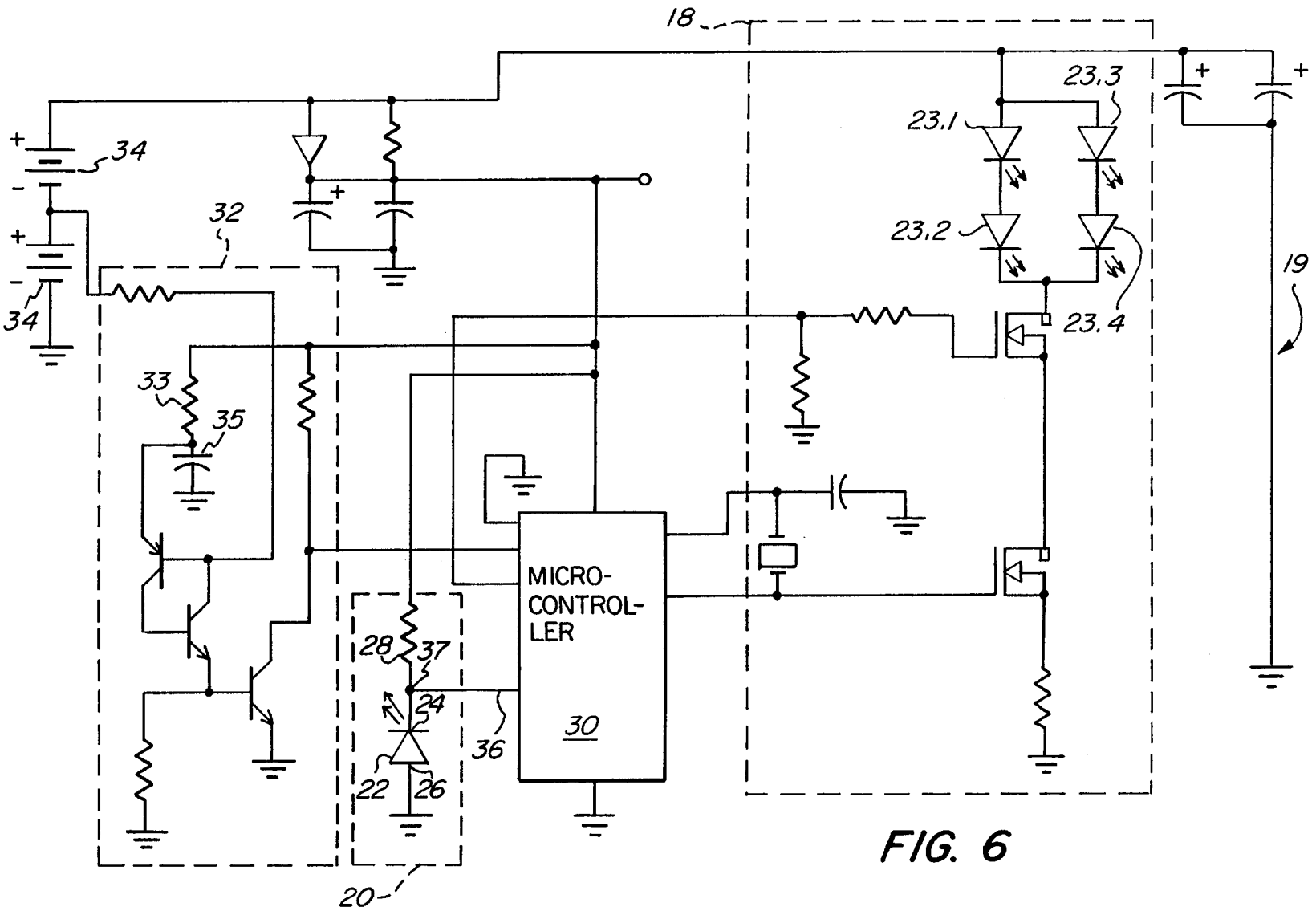
FIG. 6 is a more detailed schematic of the block diagram shown in FIG. 5.

As shown in FIGS. 5 and 6, the diode 22 has a cathode 24 and an anode 26. The anode is electrically connected to ground, while the cathode is electrically connected to a resistor 28.

FIG. 5 is a schematic block diagram of a circuit 19 which is sealed within housing 10 of badge 11. Circuit 19 includes a microprocessor 30, which is programmed with an identification code via receiver 20 to produce an electrical coded signal representative of the identification code for transmission by transmitter 18. Transmitter 18 includes, as described in the aforementioned copending patent application, at least one infrared LED, although a plurality of infrared LEDs 23.1, 23.2 23.3, 23.4 (see FIG. 6) could be used for more output and for transmission in various directions.

Circuit 19 operates on about six volts and is powered from one or more batteries 34 (see FIG. 5) which are, in a preferred embodiment, sealed inside the housing 10 although they could be installed in a replaceable manner. If the batteries 34 are replaceable, they are sufficiently hermetically sealed in an appropriate receptacle so that the badge 11 can be sterilized as needed.

Pulse generator 32 of circuit 19 sends a pulse to the microprocessor 30 once every four to ten seconds or at another desired rate by altering an RC time constant, formed by resistor 33 and capacitor 35. See FIG. 6. Microprocessor 30 has a serial input port 36 connected to a junction 37 between resistor 28 and the cathode 24 of back biased diode 22.

Figure 7:
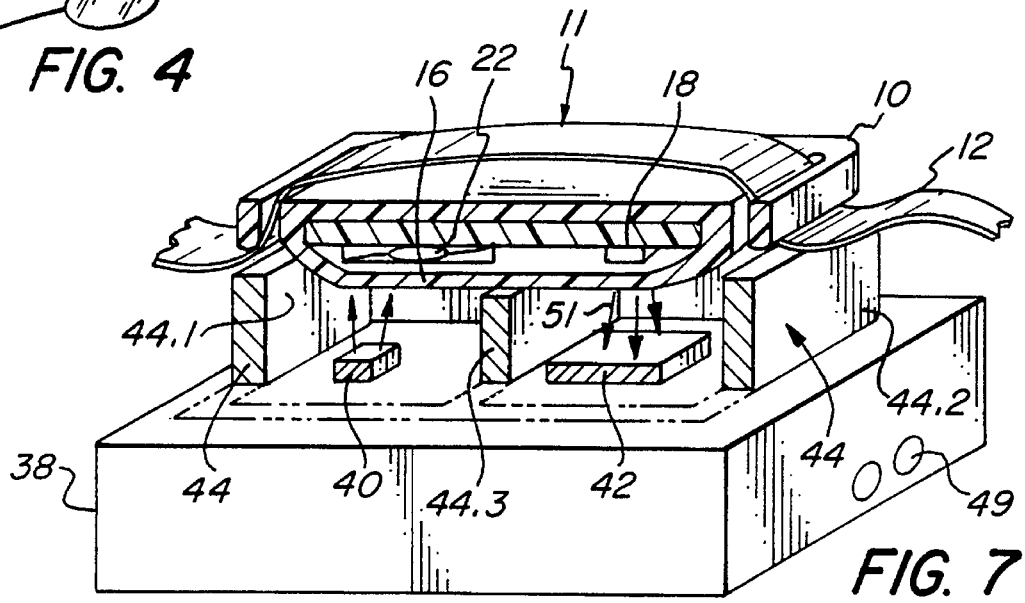
FIG. 7 is a cross-sectional view of the badge inside a programming device, with portions of the band broken away for clarity.

Referring now to FIG. 7, badge 10 is provided with an identification code by a programmer 38. For example, when used in a hospital, information corresponding to a patient number could be programmed into badge 11. Programmer 38 includes an infrared transmitter 40 and an infrared receiver 42. Badge 11 is coded by placing the badge receiver 20 over the programmer transmitter 40. The programmer transmitter 40 transmits an infrared signal of sufficient intensity to be received by the desensitized badge receiver 20.

Although badge 11 is capable of being programmed to contain an identification code, the badge may also be provided with an identification code at the time of manufacture. If the manufacturer programs badge 11 to contain an identification code, then programmer 38 is used to switch badge 11 from a low energy consuming state into a transmit mode wherein badge 11 transmits the coded signal.

The programmer transmitter 40 and programmer receiver 42 preferably operate at full duplex, therefore there is no concern for infrared coupling and no need for shielding devices.

In another embodiment, the programmer transmitter 40 and the programmer receiver 42 operate at half-duplex and use a shielding device 44 to separate the programmer receiver 42 from the programmer transmitter 40, to prevent infrared coupling therebetween. Shielding device 44 can be of any suitable shape, such as circular, square, or a single wall extending between transmitter 40 and receiver 42, and is fixed to upper portion 45 of programmer 38. The shielding device shown in FIG. 7, is essentially two rectangular shielding devices 44.1, 44.2. Shielding device 44.2 extends around programmer receiver 42. Rectangular shields 44.1, 44.2 have a common wall 44.3.

Programmer transmitter 40 and programmer receiver 42 are controlled by a personal computer (not shown) or other microprocessor including data input means for specifying an identification code. It is understood that programmer 38 includes software for providing badge 11 with commands and data as described with reference to FIG. 8.

Figure 8:
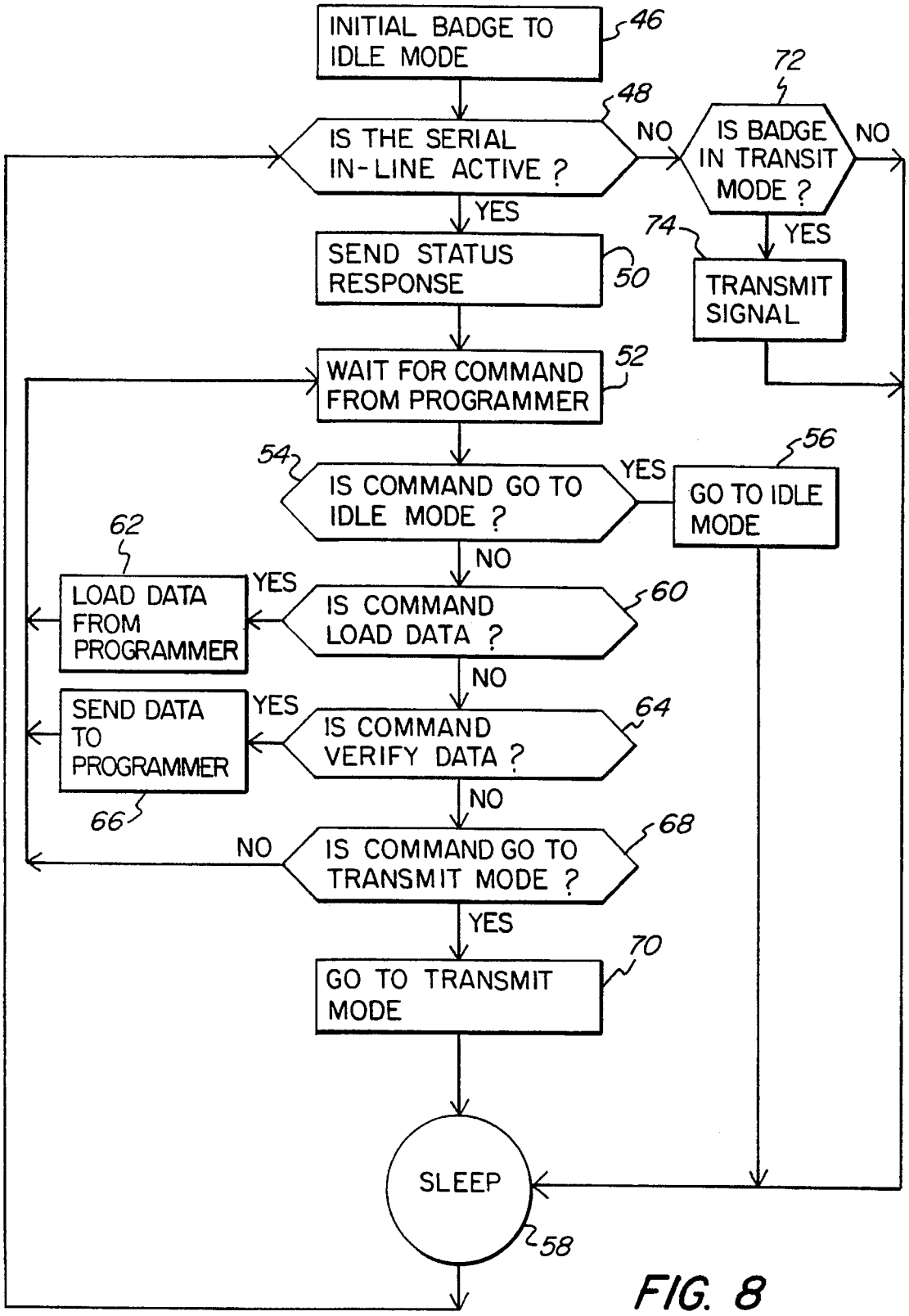
FIG. 8 is a flow chart schematically depicting operation of the badge.

Referring to FIG. 8, operation of badge microprocessor 30 is schematically illustrated. After manufacture, badge 11 is programmed to be in an "idle" mode at 46, which is a low-level energy consuming state. During idle mode, badge 11 draws minimal current in order to maximize shelf life, but periodically checks to see whether serial input port 36 (shown in FIG. 6) is active at 48. Serial port 36 is set active after a user places badge 11 within programmer 38 as illustrated in FIG. 7 and initiates the programmer via a push-button control 49 (see FIG. 7) on the programmer 38 or an appropriate key stroke on a computer keyboard. If the serial port is active, then badge 10 sends a status response at 50 to the programmer 38. The badge status response is detected by programmer receiver 42 and confirms that the badge microprocessor 30 is "awake."

After sending the status response at 50, badge 11 enters a wait mode at 52 for the detection of a command from the programmer 38. The command will be one of four commands from programmer 38 at 52. If the command is go to idle mode at 54, then badge 11 enters the idle mode at 56 and goes into a "sleep" mode at 58. If the command at 52 is to load data at 60, then the identification code at 62 is transmitted from the programmer 38 to the badge 11, then the badge 11 returns to wait for another command from programmer 38 at 52. If the command at 52 is to verify at 64, then the code that was previously loaded by badge 11 at 62 is retransmitted at 66 back to programmer 38 via IR transmission to verify that it was received and correctly stored. Badge 10 then returns to wait for another command from programmer 38 at 52.

If badge 11 is commanded at 52 to go into transmit mode, it enters a transmit mode at 70 and then returns to its "sleep" state at 58. Once badge 11 is in transmit mode, it remains in transmit mode, sequentially sleeping at 58, monitoring serial port at 48, and transmitting the infrared coded signal at 74 until returned to idle mode at 56 by a programmer command.

If the serial port is not active at 48 and badge 11 is not in the transmit mode at 72, then badge 11 returns to its sleep state at 58 and periodically monitors its serial port at 48.

After executing all tasks in the idle mode and the transmit mode, the badge 11 goes into a sleep state.

Figures 1, 9:
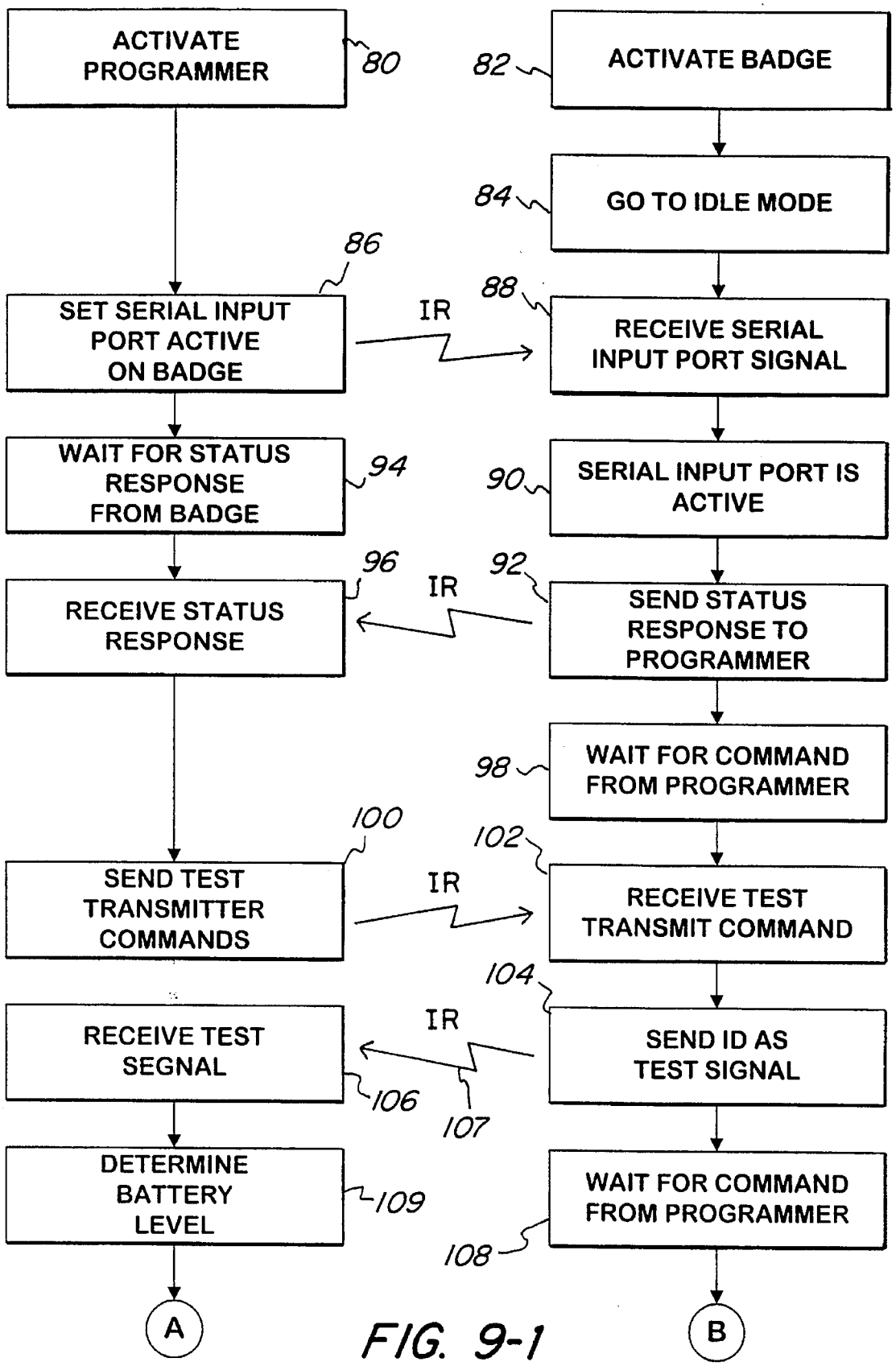
FIG. 9 is a flow chart schematically depicting the flow of information between the programmer and the badge via infrared transmission.

FIG. 9 shows one sequence of signals transmitted between the badge 11 and the programmer 38. The programmer 38 is activated by a user at 80 and the badge is activated at 82 by the manufacturer to go into an idle mode at 84, during which it monitors the serial input port 36 (shown in FIGS. 5, 6). The serial input port 36 remains inactive until activated by an infrared signal from the programmer 38 which is sent at 86.

The signal sent at 86 passes through the infrared transparent segment 16 of the housing 10 and is of sufficient strength to be detected by the back biased diode 22 (shown in FIG. 1). The signal is detected by the badge 11 at 88 so as to render the serial input port active at 90. Then the badge 11 sends a coded status response to the programmer 38 at 92, and waits at 98 for another command from the programmer 38. If the badge 11 does not receive a command from the programmer 38 within a predetermined time period, which in the preferred embodiment is approximately two seconds, then the badge 11 returns to the idle mode at 84.

The programmer 38 waits at 94 for the coded status response from the badge 11 and receives the status response at 96 by infrared transmission. If the status response is not received by the programmer 38 at 96 within a predetermined time period, then an error signal is generated (not shown) by the programmer 38 to notify the user.

The programmer 38 sends a test transmitter command at 100, which is a signal that is a function of the badge 11 battery strength. If the badge 11 has been previously loaded with an identification code, such as by a manufacturer, this coded identification signal can serve as the test transmitter command.

The command is received by the badge 11 at 102. In response, the badge 11 transmits at 104 a coded test signal 107 via infrared transmission to the programmer 38 which is received at 106. The badge 11 waits at 108 for another command from the programmer 38. If no command from the programmer 38 is received within a predetermined time period, then the badge 11 returns to the idle mode at 84.

The power from the coded test signal sent by the badge 11 in response to the test transmitter command sent at 104 can be measured at 109 to estimate the lifetime remaining for the badge batteries 34 (shown in FIGS. 2, 5, 6). The battery lifetime is measured in a manner shown in more detail in FIG. 10.

If the programmer 38 does not receive the test signal at 106 within a predetermined time period, then programmer 38 retransmits the test transmitter command at 100. If no response is received at 106 within a predetermined time period, the programmer 38 generates an error signal to notify the user.

The programmer 38 loads data, such as an identification code, at 110 into the badge 11. The badge 11 receives the load data command at 112, loads the identification code at 114, and waits at 116 for another command from the programmer 38. If no command from the programmer 38 is received within a predetermined time period, then the badge 11 returns to the idle mode at 84.

To verify that the identification code was correctly loaded into the badge 11 at 114, the programmer 38 sends a dump data command to the badge 11 at 118, which is received by the badge 11 at 120. The badge 11 transmits, or dumps, the identification code back to the programmer 38, which is received by the programmer 38 at 122 through infrared transmission. The badge 11 waits for a command from the programmer 38 at 128. If no command from the programmer 38 is received within a predetermined time period, then the badge 11 returns to the idle mode at 84.

The identification code is received by the programmer at 124 and verified for accuracy at 126. If the identification code sent by the badge 11 at 122 is determined to be accurate at 130, then the badge 11 is instructed to begin repetitively transmitting the code. The transmit command is received by the badge at 132, enters the transmit mode at 134 and periodically transmits the code at 136. The badge 11 continues to transmit the identification code until the batteries no longer provide power or until commanded by the programmer 38 to return to the idle mode at 84.

If the identification code received by the programmer 38 at 124 is inaccurate, the programmer at 138 retransmits the code at 110, and, as described above, is loaded into the badge 11 and again verified by the programmer 38. If the code is incorrectly loaded into the badge 11 after a predetermined number of attempts, the programmer 38 generates an error signal.

Figure 10:
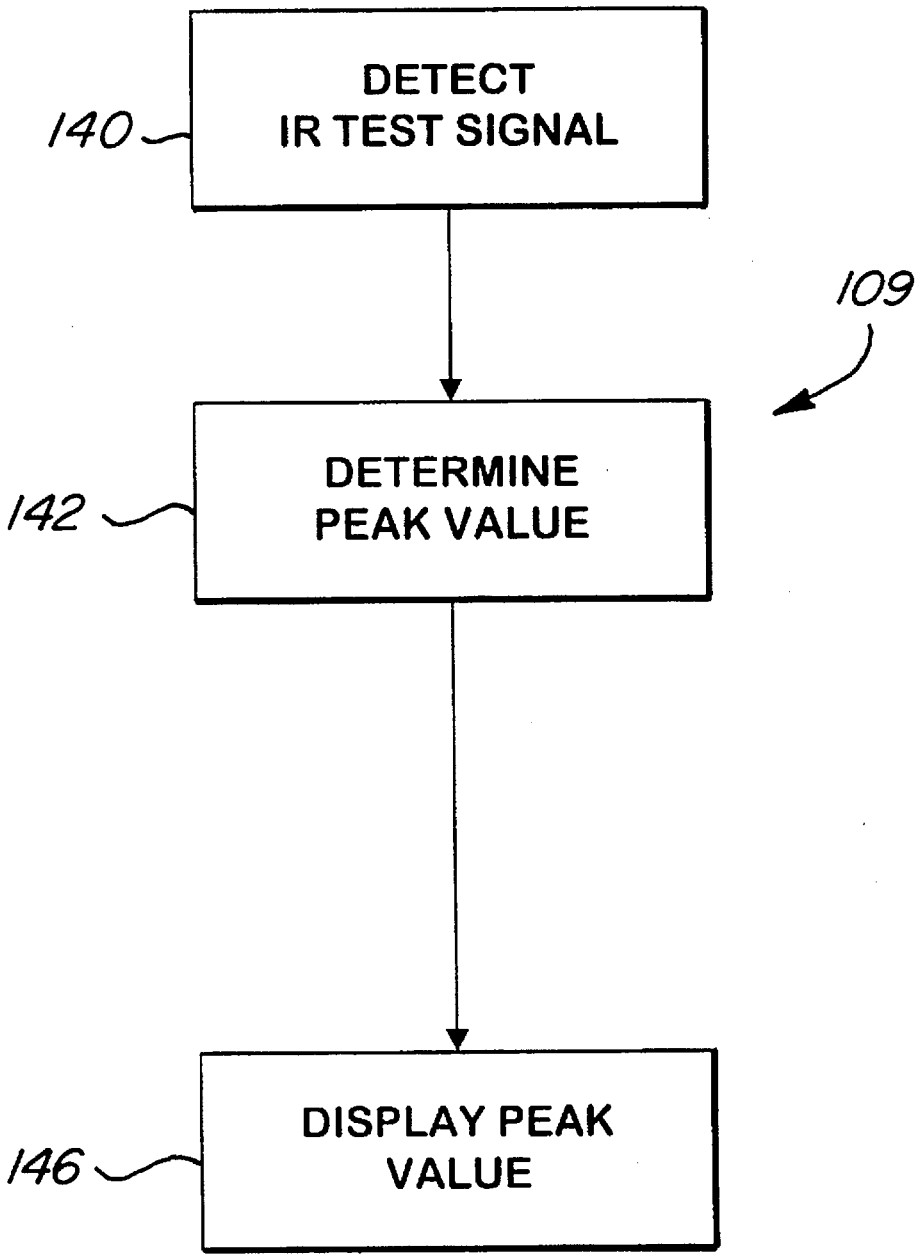
FIG. 10 is a flow chart schematically depicting one method for determining a badge battery estimated remaining lifetime.

FIG. 10 schematically depicts the steps used to estimate the lifetime remaining of the badge batteries 34 (shown in FIGS. 2, 5, 6) as generally shown at 109 in FIG. 9. The test signal from the badge 11 is received by the programmer 38 at 140, which corresponds to the test signal 107 received at block 106 of FIG. 9. The peak, or maximum value, of the signal is determined at 142. The peak is displayed to a user at 146 such as by applying the peak value to a standard voltmeter that is a part of the programmer 38. The user can then assess the estimated lifetime of the batteries. For example, a readout of one volt might indicate a suitable battery and a half volt could indicate a depleted battery.

Alternatively, the programmer 38 could be designed to assess the battery lifetime, without displaying the peak value to the user (not shown). The programmer 38 could determine the peak value, compare the peak amount to an acceptable value, and then indicate to the user whether the battery surpassed or failed to meet this acceptable value.

After badge 11 is loaded with an identification code and placed in transmit mode by programmer 38, and after badge 11 is secured to a person or thing, the location of badge 11 and hence of the person or thing can be monitored. Monitoring is accomplished by a plurality of local receivers 76, such as that schematically shown in FIG. 3, which receive the infrared coded signal periodically transmitted by badge 11 and relay it to a base unit 78 via coaxial cables 79 or the like. Base unit 78 can be a personal computer (not shown) which receives and displays the relayed coded signal along with a local receiver address. A base unit can thus monitor the location of any person wearing a badge 11 by knowing the location in which each local receiver 76 is mounted. It is understood that base unit 78 could be programmed with an alarm system or the like for indicating when a badge has moved out of an approved area.

After the user, such as a hospital patient, no longer needs badge 11, it can be disposed of or, because circuitry 19 of badge 11 is mounted in a sealed housing 10, it can be sterilized, programmed with a different identification code, and used with another patient.

Having thus described an infrared communication device in accordance with the invention, its advantages can be appreciated. Variations can be made to the illustrated embodiment without departing from the scope of the invention. For example, the badge could be programmed to transmit any suitable programmable information or other operational parameters.

What is claimed is:

1. A monitoring device comprising:

a badge comprising a sealed housing having an infrared transparent portion, the badge housing being sized and shaped so as to be worn on a user's wrist;

a battery inside the badge housing;

infrared receiving means, inside the badge housing and electrically powered by the battery, for receiving a first infrared, coded signal and communicating the first infrared, coded signal to a processing means;

processing means, inside the badge housing and electrically powered by the battery and responsive to the first infrared, coded signal, for producing and repeatedly applying a first electrical coded signal to an infrared transmitting means;

infrared transmitting means, inside the badge housing and electrically powered by the battery and responsive to the first electrical, coded signal, for generating and repeatedly transmitting a second infrared, coded signal, the transmitting means mounted within the badge housing to transmit the second infrared, coded signal through the infrared transparent portion; and a programmer having a programmer housing and transmitting means inside the programmer housing for transmitting the first, infrared coded signal to the badge, the programmer comprising means, in the programmer housing, for determining the estimated lifetime of the battery inside the badge housing, the determining means comprising:

means, in the programmer housing and operatively connected to the programmer transmitting means, for transmitting a test signal to the badge;

wherein the processing means, in the badge housing, generates a responsive signal indicative of the estimated lifetime of the battery;

means in the programmer housing for detecting the responsive signal; and means operatively connected to the programmer for displaying the battery lifetime from the responsive signal.

2. The monitoring device of claim 1, the badge further comprising desensitizing means, the desensitizing means comprising infrared attenuating material positioned between the badge housing and the infrared receiving means.

3. The monitoring device of claim 1, the badge further comprising desensitizing means, the desensitizing means comprising a back biased infrared diode coupled in an infrared detecting mode, the diode having an anode and a cathode, the anode being electrically connected to ground, and the cathode being electrically connected through a resistor to the processing means.

4. The monitoring device of claim 1, wherein the infrared transmitting means comprises an amplitude-shift-keyed infrared transmitter.

5. The monitoring device of claim 1, wherein the displaying means includes:

means for detecting a peak value of the responsive signal;

means, operatively connected to the detecting means, for determining the peak value; and means, operatively connected to the determining means, for displaying the peak value to a user, who can then assess the estimated lifetime of the battery.

6. An infrared communication system comprising:

a moisture resistant, sealed housing;

a battery sealed inside the housing;

first infrared receiving means, sealed inside the housing and electrically connected to the battery for receiving a first infrared, coded signal;

processor means, sealed inside the housing and electrically connected to the battery and the first infrared receiving means for producing a first electrical coded signal responsive to the first infrared, coded signal; and first infrared transmitting means, sealed inside the housing and electrically connected to the processor means and the battery, for repeatedly transmitting a second infrared, coded signal indicative of the first electrical coded signal; and a programmer having a programmer housing and transmitting means inside the programmer housing for transmitting the first infrared, coded signal to the sealed housing, the programmer comprising means in the programmer housing, for determining the estimated lifetime, of the battery inside the sealed housing, the determining means comprising:

means, in the programmer housing and operatively connected to the programmer transmitting means, for transmitting a test signal to the sealed housing;

wherein the processor means, in the sealed housing, generates a responsive signal indicative of the estimated lifetime of the battery;

means in the programmer housing for detecting the responsive signal; and means operatively connected to the programmer for displaying the battery lifetime from the responsive signal.

7. The infrared communications system of claim 6, further comprising means for desensitizing the first infrared receiving means to ambient infrared energy while enabling the first infrared receiving means to receive the first infrared, coded signal which is at an intensity level substantially above the intensity of ambient infrared energy.

8. The infrared communication system of claim 7, wherein the first infrared, coded signal is of sufficient intensity to be detected by the first infrared receiving means.

9. The infrared communication system of claim 8, wherein the programmer further comprises second means for receiving the second infrared, coded signal transmitted by the first infrared transmitting means, so as to verify the accuracy of the second infrared, coded signal.

10. The infrared communication system of claim 9, wherein the programmer further comprises a support member for supporting the second receiving means and the second transmitting means, and at least one shield fixed to the support member of the programmer, the shield being located between the second transmitting means and the second receiving means for preventing infrared coupling between the second transmitting means and the second receiving means.

11. The infrared communication system of claim 10, wherein the shield extends around the second transmitting means.

12. The infrared communication system of claim 10, wherein the shield extends around the second receiving means.

13. The infrared communication system of claim 6, further comprising a plurality of local receiver-transmitters having means for receiving the second infrared, coded signal transmitted by the first infrared transmitting means and having means for converting the received second infrared, coded signal to a second electrical, coded signal, and further comprising a base unit operatively connected to each of the local receiver-transmitters, the base unit having means for receiving the second electrical, coded signal relayed from the local receiver-transmitters.

14. The infrared communication system of claim 6, wherein the displaying means includes:

means for detecting a peak value of the responsive signal;

means, operatively connected to the detecting means, for determining the peak value; and means, operatively connected to the determining means, for displaying the peak value to a user, who can then assess the estimated lifetime of the battery.

15. An infrared communication system for use in a hospital, the hospital having a patient, comprising:

a sealed housing of a size and of a shape so as to fit on the patient's body, the sealed housing having an infrared transparent portion;

a battery sealed inside the housing;

a first infrared receiving means, sealed inside the housing and electrically powered by the battery, for generating an output signal in response to a first infrared, coded signal entering the sealed housing;

means for desensitizing the first infrared receiving means to ambient infrared energy;

processing means, sealed inside the housing and electrically powered by the battery, for repeatedly producing a first electrical, coded signal in response to the output signal from the first infrared receiving means;

a first infrared transmitting means, sealed inside the housing and electrically powered by the battery and responsive to the first electrical, coded signal, for repeatedly transmitting a second infrared, coded signal, the first transmitting means mounted within the sealed housing to transmit the second infrared, coded signal through the infrared transparent portion;

a remote programmer, the programmer having a housing, a second transmitting means inside the programmer housing for transmitting the first infrared, coded signal of sufficient intensity to be detected by the desensitized first receiving means; and means, in the programmer housing, for determining the estimated lifetime of the battery in the sealed housing, the determining means comprising:

means, in the programmer housing and operatively connected to the second transmitting means, for transmitting a test signal to the sealed housing;

wherein the processing means, in the sealed housing, generates a responsive signal indicative of the estimated lifetime of the battery;

means in the programmer housing for detecting the responsive signal; and means operatively connected to the programmer for displaying the battery lifetime from the responsive signal.

16. The infrared communication system of claim 15, wherein the desensitizing means includes infrared attenuating material positioned between the second housing and the first infrared receiving means, wherein the material attenuation is selected to substantially prevent the penetration of ambient light.

17. The infrared communication system of claim 15, wherein the programmer further comprises:

energizing means for electrically powering the second transmitting means; and second receiving means, electrically powered by the energizing means, for receiving the second infrared, coded signal from the first infrared transmitting means and for generating an electrical signal responsive thereto, which is transmitted by the second transmitting means.

18. The infrared communication system of claim 17, wherein the programmer further comprises a support member inside the programmer housing for supporting the second receiving means and the second transmitting means, and at least one shield fixed to the support member of the programmer, the shield being located between the receiving means and the second transmitting means for preventing infrared coupling between the second receiving means and the second transmitting means.

19. The infrared communication system of claim 18, wherein the shield extends around the second transmitting means.

20. The infrared communication system of claim 18, wherein the shield extends around the second receiving means.

21. The infrared communication system of claim 20, wherein the shield extends around the second transmitting means.

22. The infrared communication system of claim 15, wherein the displaying means includes:

means for detecting a peak value of the responsive signal;

means, operatively connected to the detecting means, for determining the peak value; and means, operatively connected to the determining means, for displaying the peak value to a user, who can then assess the estimated lifetime of the power source.

23. A communicating system, comprising:

a remote programmer, having a housing and means, inside the housing, for generating a first infrared, coded signal and means, inside the housing, for transmitting the first infrared, coded signal;

a badge having a sealed housing, a power source, and means, inside the housing and electrically connected to the power source, for receiving the first infrared, coded signal transmitted from the programmer;

processing means, inside the badge housing and electrically connected to the power source, for responding to the first infrared, coded signal and for producing a first electrical, coded signal indicative thereof; and infrared transmitting means, inside the badge housing and electrically connected to the processing means and the power source, for repeatedly transmitting a second infrared, coded signal indicative of the first electrical, coded signal;

means, in the programmer housing, for determining the estimated lifetime of the power source in the badge, the determining means comprising:

means, in the programmer housing and operatively connected to the programmer transmitting means, for transmitting a test signal to the badge;

wherein the processing means in the badge housing generates a responsive signal indicative of the estimated lifetime of the power source;

means in the programmer housing for detecting the responsive signal; and means operatively connected to the programmer for displaying the power source lifetime from the responsive signal.

24. The communicating system of claim 22, wherein the displaying means includes:

means for detecting a peak value of the responsive signal;

means, operatively connected to the detecting means, for determining the peak value; and means, operatively connected to the determining means, for displaying the peak value to a user, who can then assess the estimated lifetime of the power source.

* * * * *